US008264356B2

(12) United States Patent
Alexis

(10) Patent No.: US 8,264,356 B2
(45) Date of Patent: Sep. 11, 2012

(54) EAS ALARMING TAG WITH RFID FEATURES

(75) Inventor: Mark Alexis, Wellington, FL (US)

(73) Assignee: Sensomatic Electronics, LLC, Boca Raton, FL (US)

( * ) Notice: Subject to any disclaimer, the term of this patent is extended or adjusted under 35 U.S.C. 154(b) by 300 days.

(21) Appl. No.: 12/566,855

(22) Filed: Sep. 25, 2009

(65) Prior Publication Data

US 2011/0074582 A1 Mar. 31, 2011

(51) Int. Cl.
*G08B 13/14* (2006.01)

(52) U.S. Cl. ..... 340/572.4; 340/572.1; 340/568.1

(58) Field of Classification Search ..... 340/568.1, 340/568.2, 571, 572.1, 572.4, 572.8, 539.11, 340/539.31, 10.1, 10.3, 10.5; 235/383, 385, 235/492

See application file for complete search history.

(56) References Cited

U.S. PATENT DOCUMENTS

| | | | | |
|---|---|---|---|---|
| 6,646,550 | B1 | 11/2003 | Runyon et al. | |
| 7,109,867 | B2 * | 9/2006 | Forster | 340/572.3 |
| 7,239,238 | B2 * | 7/2007 | Tester et al. | 340/539.31 |
| 8,026,818 | B2 * | 9/2011 | Cote et al. | 340/572.7 |
| 2004/0252030 | A1 * | 12/2004 | Trimble et al. | 340/825.36 |
| 2009/0121837 | A1 * | 5/2009 | Kitayoshi et al. | 340/10.1 |
| 2009/0212920 | A1 * | 8/2009 | Yang | 340/10.3 |
| 2009/0295583 | A1 * | 12/2009 | Forster | 340/572.3 |
| 2010/0060456 | A1 * | 3/2010 | Forster | 340/572.7 |
| 2010/0277322 | A1 * | 11/2010 | Eckert et al. | 340/572.3 |
| 2010/0315239 | A1 * | 12/2010 | Yang | 340/572.9 |

FOREIGN PATENT DOCUMENTS

| | | | |
|---|---|---|---|
| GB | 2382959 | A1 | 6/2003 |
| WO | 2006086601 | A2 | 8/2006 |
| WO | 2007145907 | A2 | 12/2007 |
| WO | 2008045570 | A2 | 4/2008 |

* cited by examiner

*Primary Examiner* — Van T. Trieu
(74) *Attorney, Agent, or Firm* — Alan M. Weisberg; Christopher & Weisberg, P.A.

(57) ABSTRACT

An alarming electronic article surveillance ("EAS") tag for securing an item of merchandise includes an EAS sensor, a radio frequency identification ("RFID") logic block, an alarm transducer, and an alarming tag processor. The RFID logic block includes a transceiver, a memory and a processor. The transceiver operates to receive a first interrogation signal. The memory includes a first identifier associated with the alarming EAS tag and a second identifier associated with the item of merchandise. The processor is operable to send a first trigger signal responsive to the transceiver receiving the first interrogation signal. The alarming tag processor is electrically coupled to the RFID logic block and the EAS sensor. The alarm transducer is operable to produce at least one of a visual indicator and an audible indicator based on the EAS sensor and the alarming tag processor.

22 Claims, 3 Drawing Sheets

EAS ALARMING TAG WITH RFID FEATURES

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to alarming electronic article surveillance ("EAS") tags and more specifically to a method and system for integrating alarming EAS tags with radio frequency identification ("RFID") capabilities.

BACKGROUND OF THE INVENTION

Electronic article surveillance ("EAS") systems are commonly used in retail stores and other settings to prevent the unauthorized removal of goods from a protected area. Typically, a detection system is configured at an exit from the protected area, which comprises one or more transmitters and antennas ("pedestals") capable of generating an electromagnetic field across the exit, known as the "interrogation zone." Articles to be protected are tagged with an EAS marker that, when active, generates a response signal when passed through this interrogation zone. An antenna and receiver in the same or another "pedestal" detects this response signal and generates an alarm.

In acoustomagnetic ("AM") EAS systems, the key active element in the EAS marker is one or more strips of a melt-cast amorphous magnetic ribbon. When placed under a specific magnetic bias condition inside the marker, these strips receive and store magnetic field energy at its natural resonance frequency. As a result, once the transmitted energy source from the transmitter in the detection system is turned off, the marker becomes a signal source and is capable of radiating an electromagnetic energy at its resonant frequency. Such a signal, even small can be readily detected by the receiver, due to the absence of the transmitting field.

Certain EAS tags, commonly known as "alarming" tags, include a processor and audible alarm transducer within the actual tag device. Thus, the actual tag "knows" when it has been triggered by an EAS portal and emits an audible alert when triggered. However, typical alarming tag devices only provide audible alarms and trigger an EAS alarm without allowing any customization of the tone, e.g., frequency, volume, etc., or providing any additional information concerning the alarm event or the EAS device triggering the alarm. Additionally, there is currently no way to check the battery level of the alarming device.

Therefore, what is needed is an intelligent alarming tag and method that provide additional information about the alarm event and/or allows aspects of the alarming portion of the alarming tag to be evaluated and/or adjusted.

SUMMARY OF THE INVENTION

The present invention advantageously provides an intelligent alarming electronic article surveillance ("EAS") tag and method and for integrating radio frequency identification ("RFID") functionality therein. Generally, the alarming EAS tag includes an RFID logic block for easy configuration of the alarming EAS tag and to allow additional information to be gathered in the event of an alarm.

In accordance with one aspect of the present invention, an alarming EAS tag includes an EAS sensor, an RFID logic block, an alarming tag processor and an alarm transducer. The RFID logic block includes a transceiver, a memory and a processor. The transceiver is operable to receive a first interrogation signal. The memory includes a first identifier associated with the alarming EAS tag and a second identifier associated with the item of merchandise. The processor is operable to send a first trigger signal responsive to the transceiver receiving the first interrogation signal. The alarming tag processor is electrically coupled to the RFID logic block and the EAS sensor. The alarm transducer is operable to produce at least one of a visual indicator and an audible indicator based on the sensor and the alarming tag processor.

In accordance with another aspect of the present invention, a method is provided for securing an item of merchandise using an alarming EAS tag. The alarming EAS tag includes an alarming processor electrically coupled to an RFID logic block, an EAS sensor and an alarm transducer. The RFID logic block has a first identifier associated with the alarming EAS tag and a second identifier associated with the item of merchandise. A first interrogation signal is received. Responsive to receiving the first interrogation signal, a first trigger signal is sent to the alarm tag processor. Responsive to receiving the first trigger signal, the alarm transducer is activated to produce at least one of a visual indicator and an audible indicator based on the EAS sensor and the alarming tag processor.

In accordance with yet another aspect of the present invention, a method is provided for configuring an alarming EAS tag securable to an item of merchandise. The alarming EAS tag includes an alarming processor electrically coupled to an RFID logic block, an EAS sensor and an alarm transducer. The RFID logic block has a first identifier associated with the alarming EAS tag and a second identifier associated with the item of merchandise. A first interrogation signal is received. Responsive to receiving the first interrogation signal, a first trigger signal is sent to the alarm tag processor. Responsive to receiving the first trigger signal, a configuration mode is entered.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
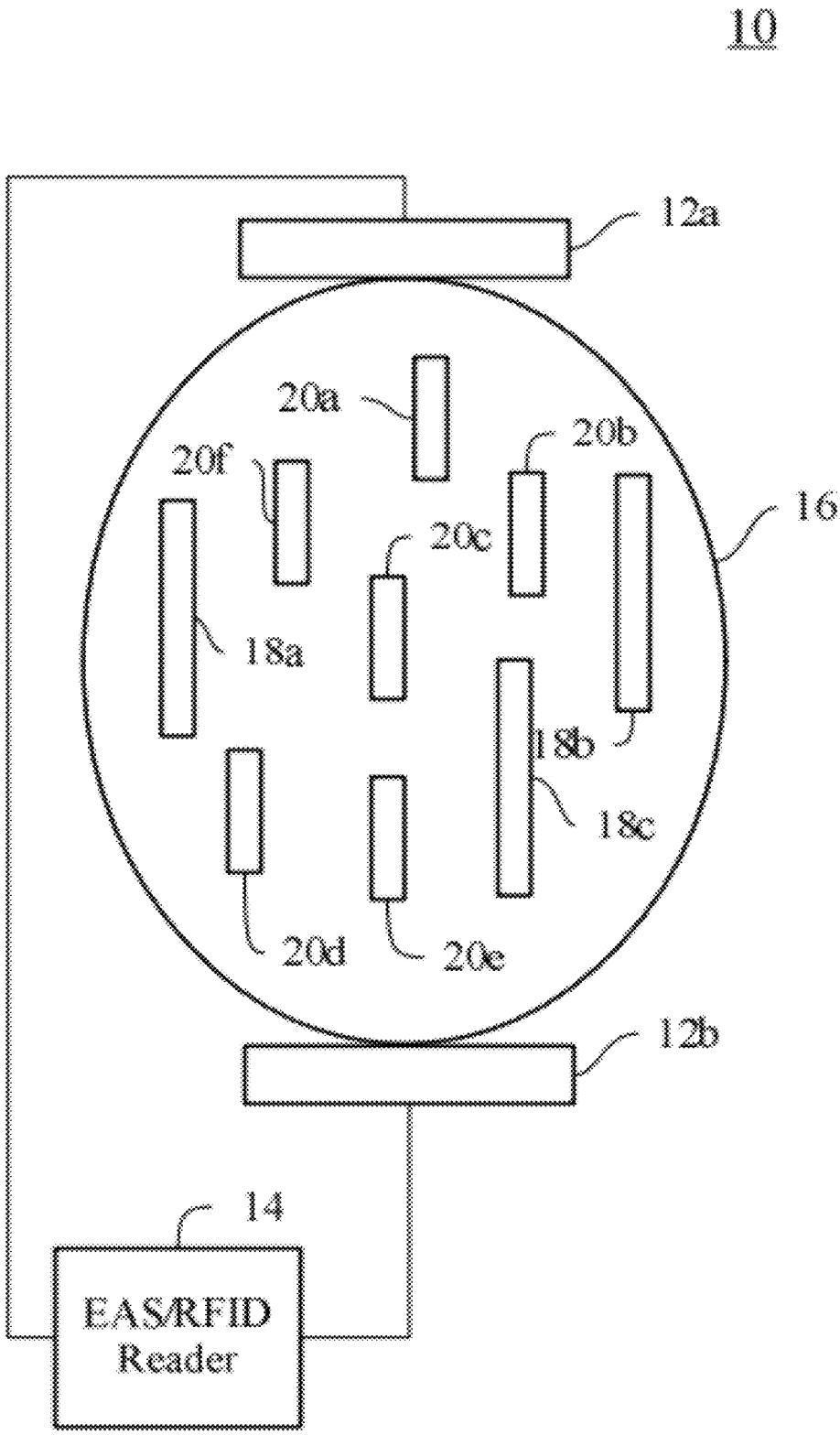
FIG. 1 is a block diagram of an exemplary electronic article surveillance ("EAS")/radio frequency identification ("RFID") system constructed in accordance with the principles of the present invention.

Before describing in detail exemplary embodiments that are in accordance with the present invention, it is noted that the embodiments reside primarily in combinations of apparatus components and processing steps related to implementing an alarming electronic article surveillance ("EAS") tag and method for integrating EAS tags with radio frequency identification ("RFID") capabilities.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides new capabilities to an EAS alarming tag through the integration of RFID features. For example, RFID functionality may be used to conserve the battery life of the alarming EAS/RFID tag, configure the alarming EAS/RFID tag, provide inventory control, and track stolen assets.

Referring now to the drawing figures in which like reference designators refer to like elements, there is shown in FIG. 1 one configuration of an exemplary EAS/RFID system 10 constructed in accordance with the principles of the present invention and located, for example, at a facility entrance. EAS/RFID system 10 includes a pair of EAS pedestals 12*a*, 12*b* (collectively referenced as pedestal 12) on opposite sides of an entrance. One or more antennas for the EAS detection system 10 may be included in EAS pedestals 12*a*, 12*b*. The antennas located in the pedestals 12 are electrically coupled to an EAS/RFID reader 14 which transmits a radio frequency signal forming an interrogation zone 16 between the pedestals 12*a*, 12*b*. The RFID reader 14 is capable of activating alarming EAS/RFID tags 18*a*, 18*b*, 18*c* (referenced collectively as "alarming EAS/RFID tag 18") and non-alarming EAS and/or RFID tags 20*a*, 20*b*, 20*c*, 20*d*, 20*e*, 20*f* (referenced collectively as "non-alarming EAS and/or RFID tags 20"). Although shown as a single device in FIG. 1, the EAS/RFID reader 14 may be implemented using separate devices to implement the EAS and the RFID functionality, respectively.

Figure 2:
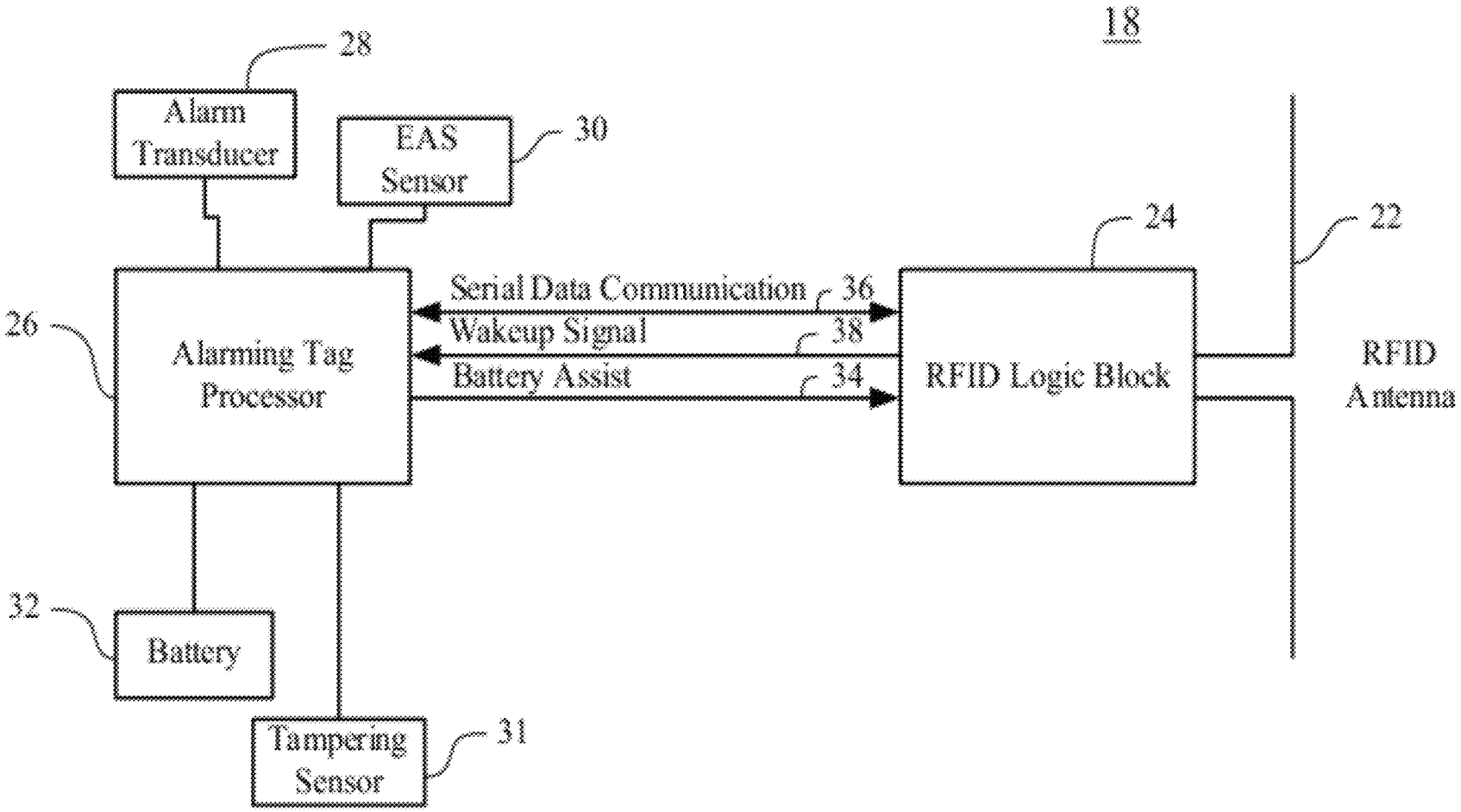
FIG. 2 is a block diagram of an alarming EAS tag with integrated RFID capabilities, constructed in accordance with the principles of the present invention.

Referring now to FIG. 2, an exemplary alarming EAS/RFID tag 18 may include a backscatter antenna 22, a microprocessor or RFID logic block 24, an alarming tag processor 26, an alarm transducer 28, an EAS sensor 30, a tampering sensor 31 and a battery 32. The backscatter antenna 22 is tuned to operate at UHF or HF frequencies. The tampering sensor 31 may also include motion sensors. The alarm transducer 28, such as a speaker and/or light-emitting diode ("LED"), emits an audible and/or visual alert when an alarm is triggered.

The RFID logic block 24 implements the behavior of a standard RFID tag. In other words, the RFID logic block 24 has the standard functionality currently found in passive UHF RFID tags including ID number, data areas, etc. In addition, the RFID logic block 24 also has the ability to have more than one ID such that the tag can appear as two tags. An article or item ID identifies the article to which the alarming tag is attached, e.g. clothing or electronic product. This item ID may be encoded to identify the item number, e.g. Uniform Product Code ("UPC"), Electronic Product Code ("EPC"), or Stock-keeping unit ("SKU") code, in addition to other types of serialization information. This encoding may be performed according to industry or customer standards. The item ID may be recorded at the point of sale when the alarming tag 18 is removed from the item, providing an immediate update to store inventory. The item ID may be used for normal RFID tracking and inventory operations in the retail environment, allowing the item to be identified at RFID read points typically implemented in the retail supply chain, such as commissioning at the point of manufacture or distribution, shipment from the distribution point, receipt at the retail store, store inventory, shelf readers, and point of sale read points.

The alarming tag ID identifies the alarming tag 18 with a unique ID. Fields within this ID allow an EAS/RFID reader 14 to easily identify the alarm tag 18 as an alarming device, not a retail item, and filter the alarming tags 18 from normal store inventory. The alarming tag ID may be changed, e.g., using a special field, according to its operating state, i.e. "alarming" or "not alarming." The alarming tag ID may also serve as the "address" of the alarm tag 18 during configuration.

The RFID logic block 24 has both passive and active operating modes. In the passive mode, the RFID logic block 24 is powered by an interrogator's field. In the active mode, the RFID logic block 24, including a transceiver, is battery powered. The battery 32 power is transferred from the alarming tag processor 26 to the RFID logic block 24 through a battery assist connection 34. Bi-directional communication occurs between the EAS alarming tag processor and the passive RFID logic block 24 via a serial data communication connection 36. When the RFID logic block 24 is activated, e.g., an interrogation signal is detected, signals from the RFID logic block 24 "wake up" the alarming tag processor 26 by activating a wakeup signal connection 38, e.g., an interrupt which toggles high or low.

By providing a bi-directional communication between the EAS alarming tag processor 26 and the passive RFID logic block 24, an ordinary RFID interrogator may be used to interact with and alter data or settings within the alarming tag logic. By architecting the layout and use of the RFID tag data area, changes to the data result in changes to the configuration and settings of the alarming tag 18. This is a useful capability since sealed alarming tags usually do not provide external connections or user interfaces to alter settings and configuration.

By extension, this data link between the EAS alarming tag processor 26 and the passive RFID logic block 24 may be used to transfer large blocks of data from the RFID tag logic 24 to the alarming tag logic 26. An example application is the ability to use an EAS/RFID reader 14 to transfer new firmware into the alarming tag logic 26, allowing for field upgrades to alarming tags 18. The use of standard EAS/RFID readers 14 for this function avoids the need to deploy specialized programming devices for such field upgrades. It should be noted that passwords protecting the RFID data areas also prevent unauthorized alteration of the alarming tag logic and function.

Figure 3:
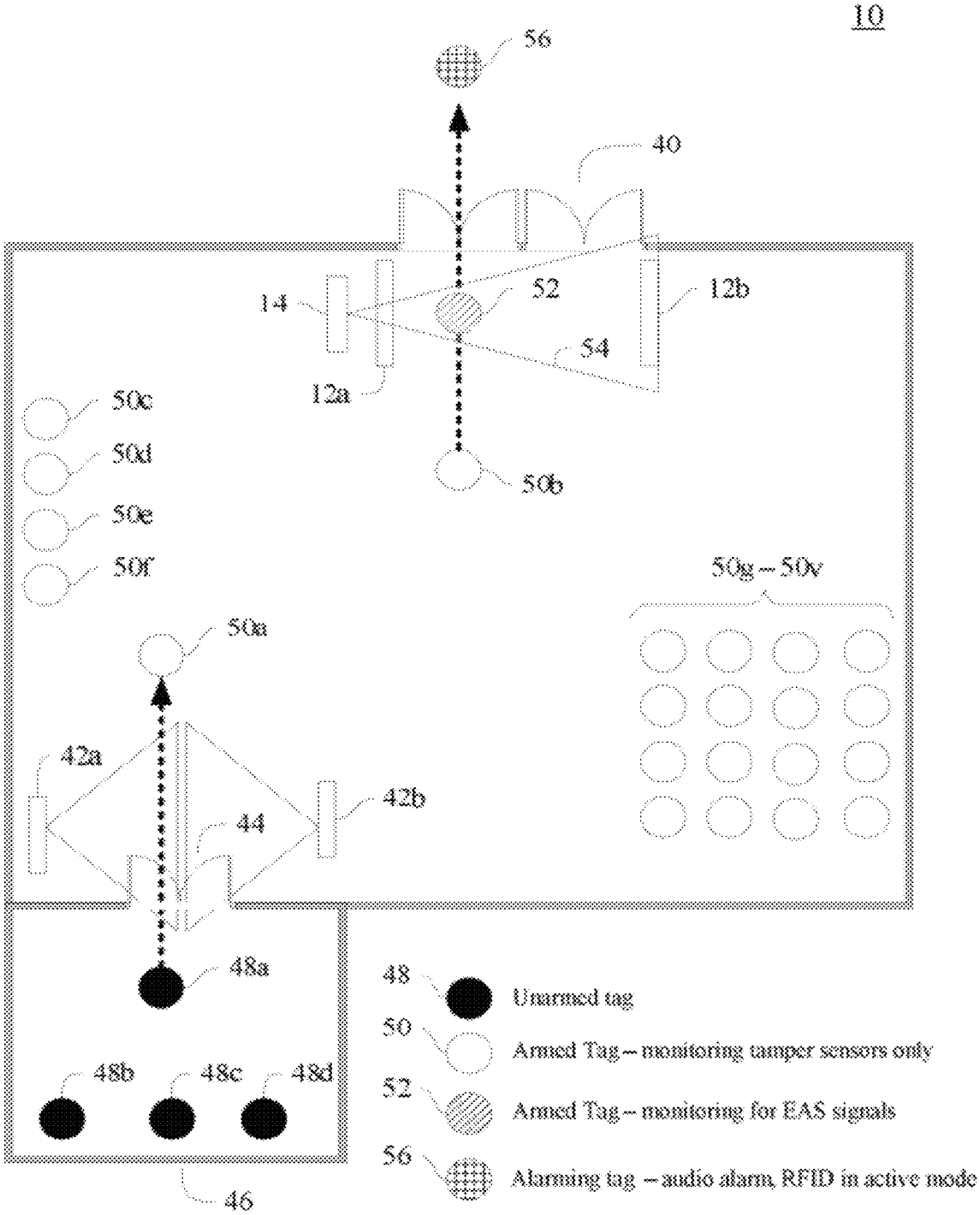
FIG. 3 is a flow diagram of an exemplary EAS/RFID system illustrating alarming EAS tags in various stages of power consumption according to the principles of the present invention.

Without the improvement of the present invention, an alarming tag had to periodically wake up to monitor sensors and determine if the tag needed to alarm, e.g., to determine if the tag is moving through the EAS pedestals 12. By using the passive RFID logic block 24 and a properly programmed EAS/RFID reader 14, the alarming tag may remain idle, i.e. little or no battery power consumed, until it receives a wakeup signal from the RFID logic block 24. In one example, as shown in FIG. 3, an exemplary RFID/EAS system 10 may include EAS pedestals 12 and EAS/RFID readers 14 located at a retail store exit 40 and at least one additional RFID reader 42*a*, 42*b* (referenced collectively as "RFID reader 42") located at an entrance 44 to a storage area 46 for inventory and/or stock control purposes. When the RFID portion of the EAS/RFID reader 14 located at the store exit 40 detects a tag having an alarming tag ID that identifies the tag as an alarming tag, the reader 14 may instruct the tag to wake up and begin monitoring its EAS sensor 30.

Alarming EAS tags may be in one of four states, ranging from zero power consumption to high power consumption. Unarmed tags 48*a*, 48*b*, 48*c*, 48*d* (referenced collectively as "unarmed tag 48"), such as the tags 48 located in the storage area 46, are not armed, therefore they consume virtually no power at all For example, the tag 48 can be operated in a passive mode in which power from the RF interrogation signal is used to wake the tag 48 and change the status to an armed state, which can then in turn move the tag 48 to an active mode. Of course, the tag 48 can also be in an active mode all of the time and woken up between very long time intervals. A tag transitions from the unarmed state to an armed state when it moves out of the storage area 46. The RFID readers 42 at the store room exit 44 detect the ID of the tag 48*a* and if the tag is unarmed, wake up the tag 48*a* and command it to enter the armed state using an RFID command.

In order to ascertain whether a tag 18 is armed or unarmed, RFID logic block 24 includes a data area that the reader 14 (FIG. 1) accesses to check the state of the tag 18. Reader 14 is programmed such that it is aware of the data area in RFID logic block 24 storing the arming state information as well as how the alarming state information is encoded. For example, it is contemplated that a manufacturer of the alarming tag 18 would publish this information so that an industry standard reader could be programmed accordingly Armed tags 50*a*-50*v* (referenced collectively as "armed tag 50"), are located throughout the store and will alarm if their tampering sensors 31 are disturbed. Periodic monitoring of these sensors 31 uses very low power levels. When a tag 18 becomes armed, alarming tag processor 26 is activated. In this case, armed tag 50 is periodically woken so that alarming tag processor 26 can monitor sensors 30 and 31 to ensure the item armed tag 50 is attached to is not being stolen or tampered with. Because this consumes power from battery 32, it is desirable to have the tag 50 armed only when necessary, e.g., for instance when the tag 50 is attached to a retail item on the sales floor.

Although alarming tags 50 are armed, they are in a very low power consumption state in which the tag 50 wakes up periodically and verifies its tamper sensors 31 to determine if the tag 50 has been removed or defeated by a thief. The wakeup interval for detecting this tampering may be relatively long, e.g., seconds or minutes, and therefore consumes very little power.

When an item is being stolen from the store, such as an item secured by tag 50*b*, the RFID readers 14 detect this alarming tag 52 when the tag enters the interrogation zone 54 and is identified as an alarming tag, e.g., alarming tags may have a specific EPC code range. The RFID reader 14 commands the tag 52 to either begin alarming immediately or start monitoring its EAS sensor 30 to detect an EAS alarm signal. Monitoring for EAS signals requires a relatively high wakeup interval, i.e., the tag 52 is woken up often, and therefore consumes proportionately more battery power. By using RFID commands to put the alarming tag 52 in this state only when near the store exit 40, the power consumption is limited to only moments when the tag and attached item are likely to be stolen.

Tags triggered to alarm, e.g., tag 56, enter a fully alarming mode which triggers the alarm transducer 28 to sound an audible alarm and/or flash a visible alarm, such as an LED or other light. Triggered tags 56 are in the highest power consumption mode as the alarm transducer 28 is activated as well as the RFID logic block 24 being fully active to transmit information relating to the alarm event, e.g., alarming tag ID, item ID, etc., back to the RFID reader 14.

A timeout or disarm command may be used to return the tag to armed/low power mode after it leaves the exit area of the store if the tag returns to the store interior.

Using this scheme, alarming tags advantageously only consume battery power when they are near the store exits.

An alarming tag 18 may be configured using a standard RFID interrogator by using RFID read and write commands. The use of standard RFID interrogators, e.g., handheld devices, eliminates the need for additional hardware to maintain a population of alarming tags 18. Configuration may be performed without physical connection to the alarming tag 18, using the wireless air protocol of the RFID interrogator. For security purposes, the password protection implemented in the RFID protocol prevents unauthorized configuration of the alarming tag 18.

Parameters that may be adjusted during configuration may include, but are not limited to the volume of the alarm tone, the frequency and/or duty cycle of alarm tone, the sensitivity of the tampering and/or motion sensors, enabling/disabling various types of EAS protocols, e.g., turn on swept RF function, encoding the item ID of the item attached to the alarming tag, encoding the alarming tag ID, enabling/disabling the alarm tone. Other functions that may be performed during configuration may include reading the battery charge condition of the alarming tag, triggering a diagnostic routine on the alarming tag and read back the test result, and downloading or "reflashing" firmware to the alarming tag processor 26. An RFID interrogator may also command an alarming tag 18 to flash an LED or produce a sound so that a defective tag or one with low battery can easily be identified in a rack of multiple retail items or commanding an alarming tag 18 with a specific ID to flash its LED or produce a sound. This feature may be used in a retail store to locate and retrieve a particular retail item in a dense rack of retail items. Configuration commands may also be used to turn off a group of tags that have started alarming. Prior to the present invention, each of the alarming tags had to be handled and disabled, one at a time.

The alarming tag ID, in combination with the item ID of the item to which it is attached, may be used so that EAS/RFID readers 14 at the retail store exit and beyond the store may record the observation of an item that has been removed without authorization, e.g., a shoplifted item. In a retail environment such as a shopping mall, EAS/RFID readers 14 located throughout the mall and in the parking areas may be used to assist security personnel to locate and retrieve a stolen item after it has left the store front. The use of the battery 32 in the alarming tag 18 allows RFID detection of the alarming tag 18 at much greater range than an ordinary passive tag. Information about EAS alarm events is enhanced by knowing what specific items that triggered an EAS alarm, i.e. by using the item ID. The RFID features of the alarming tag 18 of the present invention advantageously enable retail store personnel to quickly locate items in the store that are tagged with alarming tags 18, allowing personnel to re-program alarming tags 18, to quickly locate alarming tags in an alarm state, or to quickly locate high value items in the store.

The present invention can be realized in hardware, software, or a combination of hardware and software. Any kind of computing system, or other apparatus adapted for carrying out the methods described herein, is suited to perform the functions described herein.

A typical combination of hardware and software could be a specialized computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. An alarming electronic article surveillance ("EAS") tag for securing an item of merchandise, the alarming EAS tag comprising:

an EAS sensor;

a radio frequency identification ("RFID") logic block including:

a transceiver operable to receive a first interrogation signal;

a memory including a first identifier associated with the alarming EAS tag and a second identifier associated with the item of merchandise; and a processor operable to send a first trigger signal responsive to the transceiver receiving the first interrogation signal;

an alarming tag processor electrically coupled to the RFID logic block and the EAS sensor; and an alarm transducer operable to produce at least one of a visual indicator and an audible indicator based on the EAS sensor and the alarming tag processor.

2. The alarming EAS tag of claim 1, wherein the second identifier is one of a Uniform Product Code ("UPC"), an Electronic Product Code ("EPC"), and a Stock-keeping unit ("SKU") code.

3. The alarming EAS tag of claim 1, wherein the first interrogation signal includes an identifier matching the first identifier, the processor is further operable to send the first trigger signal responsive to determining that the identifier in the interrogation signal matches the first identifier.

4. The alarming EAS tag of claim 1, wherein the transceiver is further operable to transmit a response signal, the response signal including at least one of the first identifier and the second identifier.

5. The alarming EAS tag of claim 1, further comprising a battery in communication with the RFID logic block; and the alarming tag processor is operable to:

receive the first trigger signal; and responsive to receiving the first trigger signal, enter one of an active mode and a configuration mode, the active mode triggering the RFID logic block to operate using power supplied by the battery.

6. The alarming EAS tag of claim 5, wherein the alarming tag is unarmed prior to receiving the first trigger signal.

7. The alarming EAS tag of claim 5, wherein the alarming EAS tag further comprises at least one tampering sensor, when the alarming tag processor enters the active mode, the alarming tag processor is further operable to:

monitor the at least one tampering sensor; and responsive to detecting that the at least one tampering sensor has been triggered, activate the alarm transducer.

8. The alarming EAS tag of claim 7, wherein the transceiver is further operable to receive a second interrogation signal:

the alarm processor is further operable to send a second trigger signal responsive to the transceiver receiving the second interrogation signal; and the alarming tag processor is further operable to:

receive the second trigger signal; and responsive to receiving the second trigger signal, activate the alarm transducer.

9. The alarming EAS tag of claim 7, wherein the transceiver is further operable to receive a second interrogation signal:

the alarm processor is further operable to send a second trigger signal responsive to the transceiver receiving the second interrogation signal; and the alarming tag processor is further operable to:

receive the second trigger signal;

responsive to receiving the second trigger signal, monitor the EAS sensor; and responsive to receiving an EAS alarm signal, activate the alarm transducer.

10. The alarming EAS tag of claim 1, wherein the alarming tag processor is further operable to adjust an alarming tag parameter.

11. The alarming EAS tag of claim 10, wherein the alarming tag parameter includes at least one of an alarm tone volume, an alarm tone type, an EAS protocol type enablement, a sensor sensitivity, the first identifier, the second identifier, and an alarm tone enablement.

12. The alarming EAS tag of claim 1, further comprising a battery in electrical communication with the alarming tag processor, wherein the alarming tag processor is further operable to read a battery charge condition.

13. The alarming EAS tag of claim 1, wherein the alarming tag processor is further operable to trigger a diagnostic routine.

14. The alarming EAS tag of claim 1, wherein the RFID logic block is further operable to download firmware to the alarming tag processor.

15. The alarming EAS tag of claim 1, further comprising a battery in communication with the RFID logic block, the first interrogation signal triggering the RFID logic block to operate using power supplied by the battery.

16. The alarming EAS tag of claim 1, wherein the first interrogation signal initiates monitoring of at least one tamper sensor; and the transceiver is further operable to receive a second interrogation signal, the second interrogation signal initiates monitoring of the EAS sensor.

17. A method for securing an item of merchandise using an alarming electronic article surveillance ("EAS") tag, the alarming EAS tag including an alarming processor electrically coupled to a radio frequency identification ("RFID") logic block, to an EAS sensor, to at least one tampering sensor and to an alarm transducer, the RFID logic block having a first identifier associated with the alarming EAS tag and a second identifier associated with the item of merchandise, the method comprising:

receiving a first interrogation signal;

responsive to receiving the first interrogation signal, sending a first trigger signal to the alarm tag processor;

receiving the first trigger signal; and responsive to receiving the first trigger signal, monitoring the at least one tampering sensor; and responsive to detecting that the at least one tampering sensor has been triggered, activating the alarm transducer to produce at least one of a visual indicator and an audible indicator based on the EAS sensor and the alarming tag processor.

18. The method of claim 17, further comprising:

determining that the first interrogation signal includes an identifier matching the first identifier; and sending the first trigger signal responsive to determining that the identifier in the interrogation signal matches the first identifier.

19. The method of claim 18, further comprising:

transmitting a response signal, the response signal including at least one of the first identifier and the second identifier.

20. The method of claim 17, further comprising:

receiving a second interrogation signal;

responsive to receiving the second interrogation signal, sending a second trigger signal;

receiving the second trigger signal; and responsive to receiving the second trigger signal:

monitoring the EAS sensor; and responsive to receiving an EAS alarm signal, activating the alarm transducer.

21. A method for configuring an alarming electronic article surveillance ("EAS") tag securable to an item of merchandise, the alarming EAS tag including an alarming processor electrically coupled to a radio frequency identification ("RFID") logic block, an EAS sensor and an alarm transducer, the RFID logic block having a first identifier associated with the alarming EAS tag and a second identifier associated with the item of merchandise, the method comprising:

receiving a first interrogation signal;

responsive to receiving the first interrogation signal, sending a first trigger signal to the alarm tag processor;

receiving the first trigger signal; and responsive to receiving the first trigger signal, entering a configuration mode.

22. The method of claim 21, wherein the configuration mode includes at least one of adjusting an alarming tag parameter, reading a battery charge condition, triggering a diagnostic routine and downloading firmware to the alarming tag processor.

* * * * *